United States Patent [19]

Biebuyck

[11] 4,006,573

[45] Feb. 8, 1977

[54] NARROW FRAME WALL STRUCTURE

[75] Inventor: Lawrence F. Biebuyck, Dallas, Tex.

[73] Assignee: Howmet Corporation, New York, N.Y.

[22] Filed: Aug. 29, 1975

[21] Appl. No.: 608,838

[52] U.S. Cl. ..... 52/732; 52/399; 52/206; 52/207

[51] Int. Cl.² ..... E04C 3/32; E04B 1/48; E06B 1/04

[58] Field of Search ..... 52/396–402, 52/495, 732, 476, 731, 656, 706

[56] References Cited

UNITED STATES PATENTS

| | | | |
|---|---|---|---|
| 3,147,518 | 9/1964 | Horgan | 52/476 |
| 3,160,245 | 12/1964 | Pavlecka | 52/586 |
| 3,267,629 | 8/1966 | Waring et al. | 52/397 |
| 3,352,078 | 11/1967 | Neal | 52/397 |
| 3,719,014 | 3/1973 | Sukolics | 52/495 |
| 3,881,287 | 5/1975 | Biebuyck | 52/732 |

*Primary Examiner*—James L. Ridgill, Jr.
*Attorney, Agent, or Firm*—Thomas L. Cantrell; Joseph H. Schley

[57] ABSTRACT

Disclosed is a narrow frame wall structure having panel gripping mullions formed of extruded metal. Typical vertical mullions comprise a mullion proper with a glazing pocket on one side and one half of a glazing pocket on the other side, a mullion stop attached to the mullion proper after installation of a panel, and a mullion filler snap-locked to the mullion proper and the mullion stop to provide the remaining half of the second glazing pocket, thereby providing easy glazing and adequate glass bite notwithstanding the narrowness of the mullion. Joints between vertical and horizontal mullions are formed with joint pins positioned internally of the horizontal mullions on internal splines, and abutting, passing into or through, the vertical mullion, with predrilled screw holes in the pin so located that a screw hole is positioned a predetermined distance from the side of the vertical mullion in every standard location of the pin.

7 Claims, 15 Drawing Figures

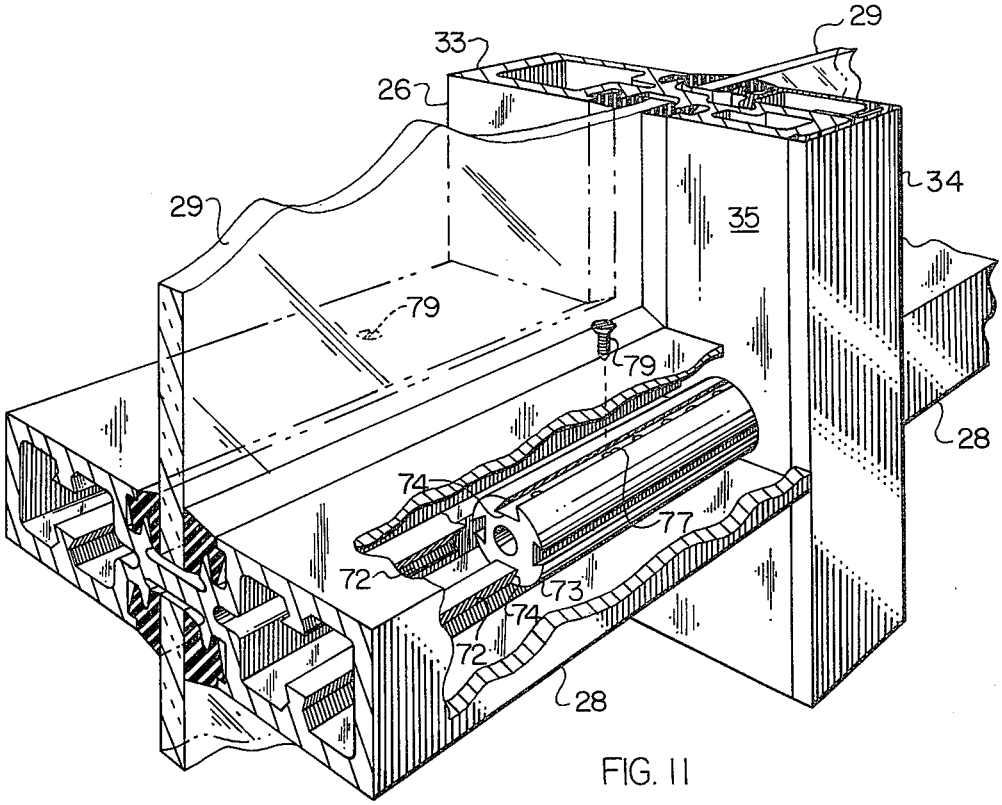
FIG. 11
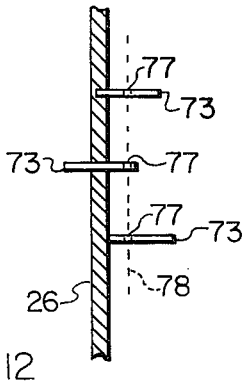
FIG. 12
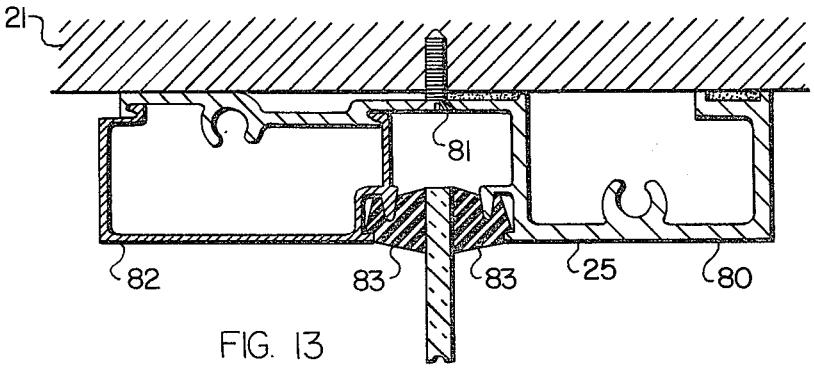
FIG. 13
FIG. 14
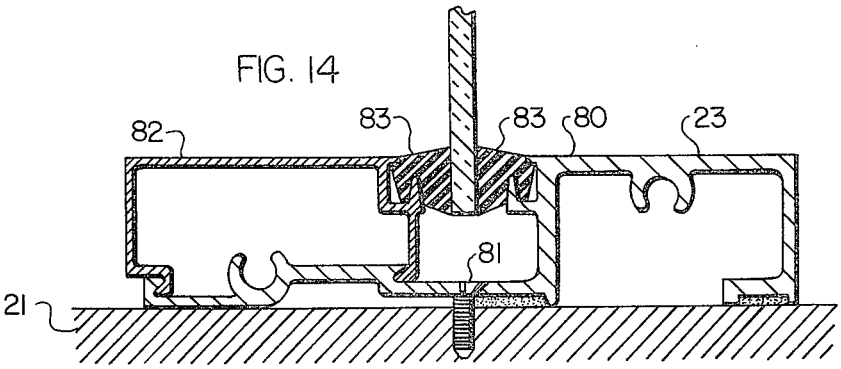

NARROW FRAME WALL STRUCTURE

BACKGROUND OF THE INVENTION

Metal framing systems for holding glass and various kinds of opaque panels have been in use for some time, both for store front applications and for light and heavy curtain walls. In store fronts and in light curtain walls, a trend has developed in the direction of making the elements of the framing systems as narrow as possible for aesthetic reasons. Typical narrow mullions presently being installed are about one and three fourths inches wide, i.e. the same width as "two-by-four" finished lumber. Problems are encountered in making mullions narrower than this width. First, panel installation (glazing) becomes more difficult because there is less "maneuvering room" in the glazing pockets prior to installation of the glazing gaskets. In addition, the narrowness of the mullion reduces the depth by which the mullion grips the panel (termed "glass bite") if a conventional extrusion profile is employed. Furthermore, the restricted space available in the hollow interior of a narrow mullion makes conventional joint forming techniques with internal brackets difficult to apply to produce a joint between vertical and horizontal mullions having adequate strength.

SUMMARY OF THE INVENTION

In accordance with the present invention, a wall framing system is provided in which the mullions may be as narrow as one inch or even somewhat less, while still providing easy panel installation, ample glass bite, and strong joints.

The system utilizes vertical mullions which are multipart and which are assembled together in the course of glazing. The parts of the vertical mullion include the mullion proper (or mullion base piece), a mullion stop, and a mullion filler. The mullion proper is formed, preferably by extrusion of aluminum, in a generally rectangular shape, with opposed glazing pockets on the long sides of the rectangle, and with approximately one quadrant of the rectangle omitted. Stated differently, the mullion proper is formed with one complete glazing pocket on one side and one-half of a glazing pocket on the other. Both the complete and partial glazing pockets are provided with suitable protrusions or grooves for engaging and gripping resilient glazing gaskets.

The mullion stop is shaped for attachment to the mullion proper to bring it to full width on the narrow side where the omitted quadrant of the mullion proper is located. The mullion stop and the mullion proper are attached together by any convenient means which may be applied in the field, such as screws or rivets.

The mullion filler is shaped for attachment to the mullion proper and mullion stop to supply the remaining half of the second glazing pocket and the remainder of the long side of the mullion in the area where the omitted quadrant of the mullion proper is located. Thus the mullion stop and mullion filler together provide the quadrant of the mullion which was omitted from the mullion proper. The mullion filler, in its glazing pocket region, is provided with suitable protrusions or grooves for engaging and gripping resilient glazing gaskets. The preferred mode of attachment of the filler to the stop, and to the mullion proper, is by interlocking engagement with grooves and/or protrusions located on those parts.

Both the mullion stop and the mullion filler are attached to the mullion proper after the panel is positioned in the half-formed glazing pocket of the mullion proper. They are thus not in the way during positioning of the panel.

In accordance with another aspect of the invention, an improved joint structure is provided which is strong, easy to install, and adaptable to the various constructional situations encountered in a wall system, such as the meeting of a horizontal and a vertical mullion, or the meeting of a horizontal mullion and a vertical jamb.

In the joint structure, continuous splines or keys are formed on the upper and lower interior walls of the horizontal mullion. The structure also includes a joint pin of substantial diameter having keyways formed therein for engaging the splines of the mullion. The pin also has an axial bore so that it can be brought into abutment with a mullion wall and attached thereto by a screw passing through the wall and into the bore. In addition the pin is provided with a series of transverse screw holes, radially aligned with the keyways. In some joints, the joint pin is passed through one or both walls of the vertical mullion, through holes bored therein. The transverse screw holes are positioned along the length of the joint pin so that no matter which of the standard positions the pin is placed in —abutting a vertical mullion, passing through one mullion wall, passing through both mullion walls, etc. —there is a screw hole located a single pedetermined distance from the wall of the vertical mullion or jamb. Thus a worker installing the wall system can easily locate the proper position to drill an aligned hole in the horizontal mullion, and install a screw fastening the pin and horizontal mullion together.

From the foregoing, it can be seen that the principal object of the present invention is the provision of a superior narrow wall framing system, although it should be understood that various features of the invention can be applied advantageously to wall framing systems generally, including those which are not "narrow", as that term is used herein.

It is a further object of the invention to provide a wall system which is readily glazable.

A further object of the invention is the provision of a narrow wall framing system which nonetheless has a maximized glass bite.

Another object of the invention is the provision of a wall framing system, particularly a narrow system, having a novel joint system therein which is strong and simple to install.

The manner in which the foregoing objects and purposes, together with other objects and purposes, are accomplished may best be understood from the detailed description which follows, together with the accompanying drawings.

Figure 1:
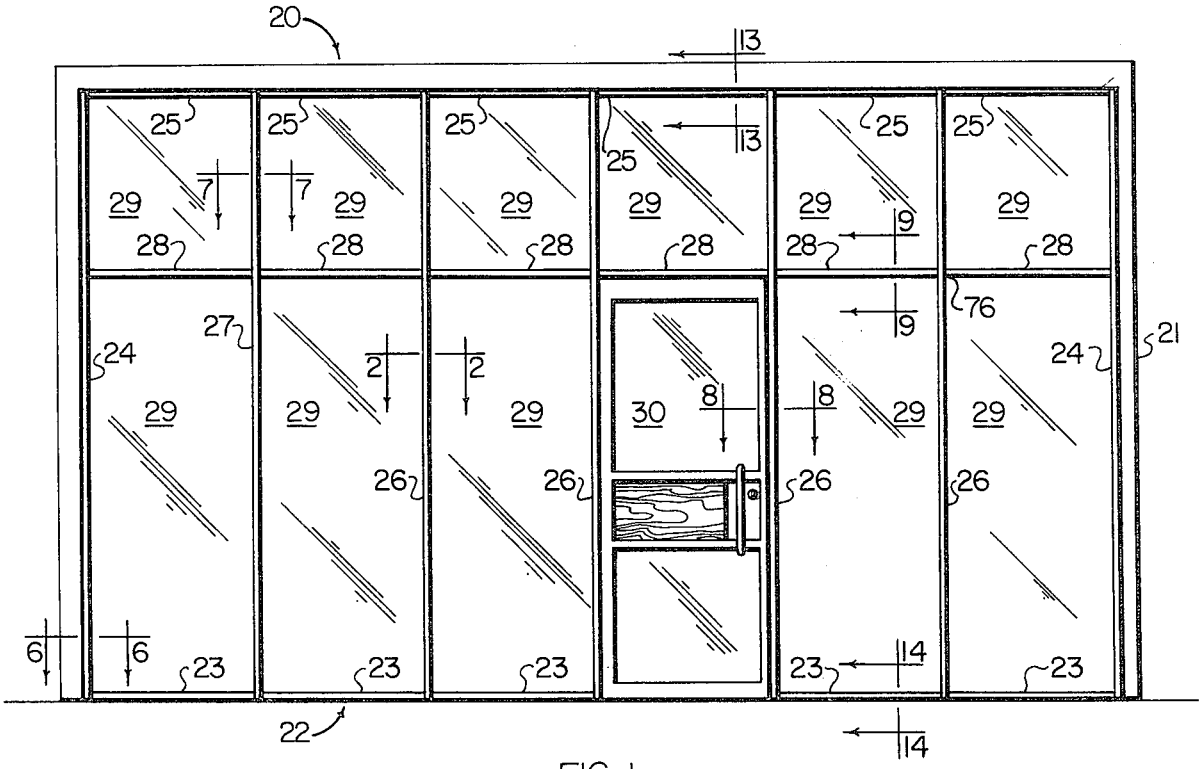
FIG. 1 is a diagrammatic elevational view of a building front employing the wall framing system of the invention.
Figure 6:
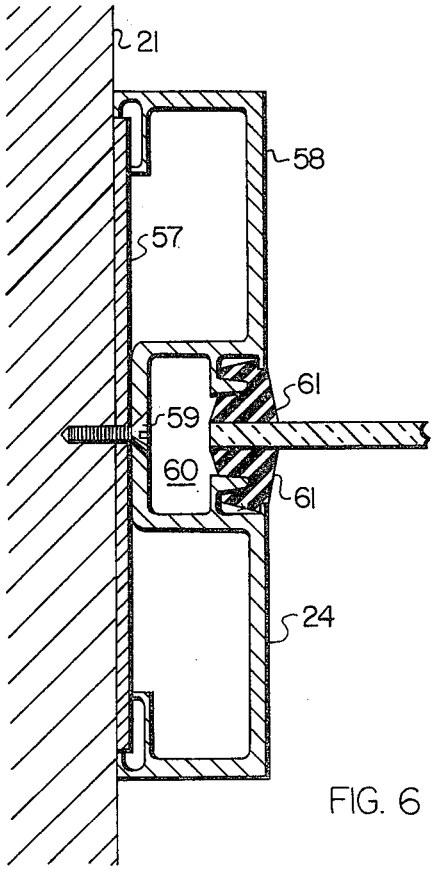
Figure 7:
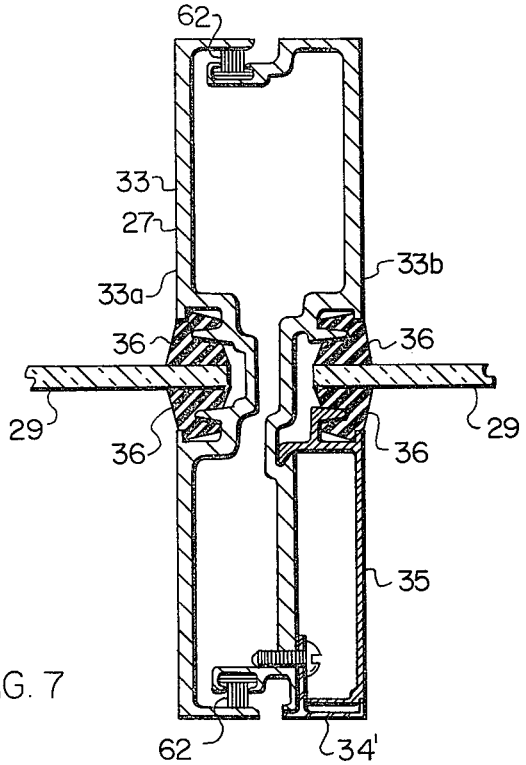
Figure 8A:
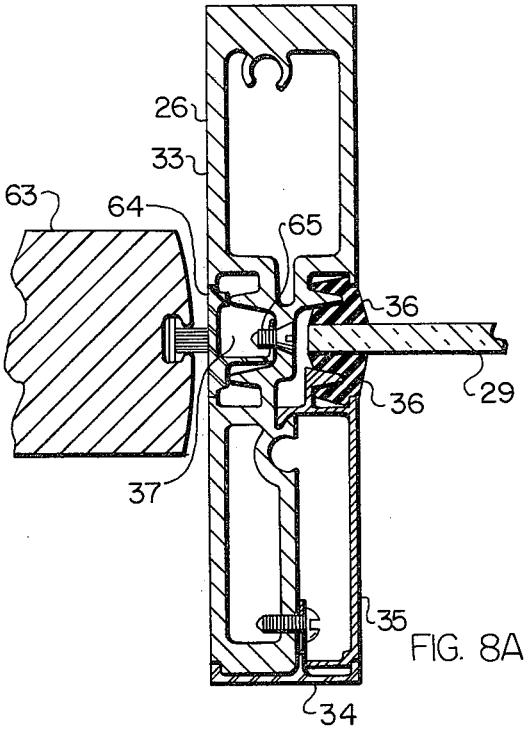
Figure 8B:
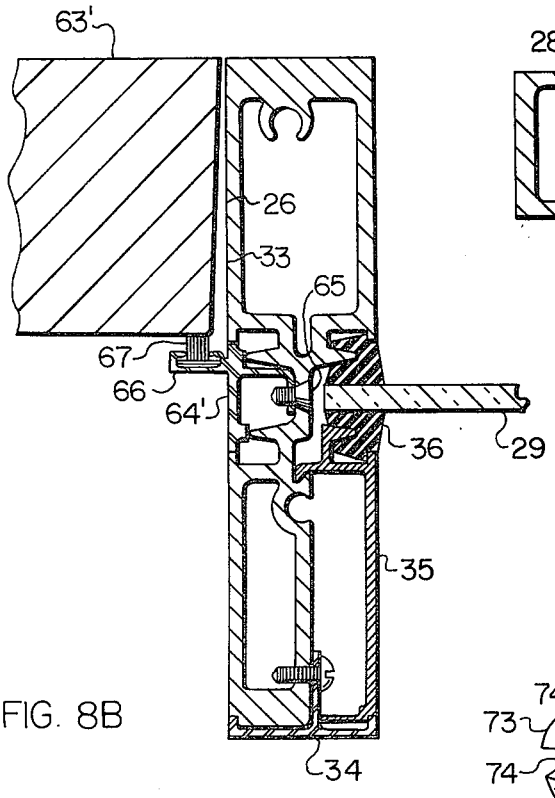
Figure 9:
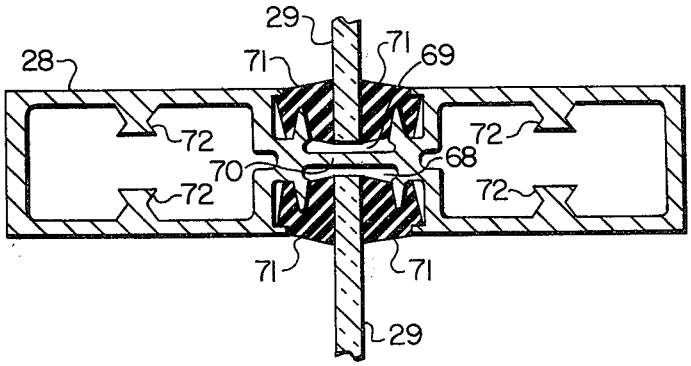
Figure 10:
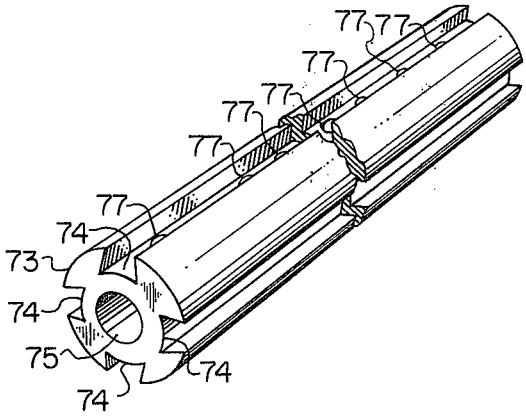

2, and the interior structure of the mullions being somewhat simplified for clarity;

FIG. 6 is a cross sectional plan view of a typical vertical jamb member, the section being taken on the line 6—6 of FIG. 1;

FIG. 7 is a cross sectional plan view of a vertical expansion mullion, the section being taken on the line 7—7 of FIG. 1;

FIGS. 8A and 8B are cross sectional plan views of vertical mullions modified to act as door frames for center-hung and edge hung doors respectively, the section being taken on the line 8—8 of FIG. 1;

FIG. 9 is a cross sectional elevational view of a typical horizontal mullion, the section being taken on the line 9—9 of FIG. 1;

FIG. 10 is an isometric view, partly broken out, of a joint pin constructed in accordance with the invention;

FIG. 11 is a fragmentary isometric view, partly broken away, of a typical joint between vertical and horizontal mullions, and showing the joint pin;

FIG. 12 is a very diagrammatic elevational view showing various positions of the joint pin of the invention with respect to a vertical mullion;

FIG. 13 is a cross sectional elevational view of a typical header, the section being taken on the line 13—13 of FIG. 1; and FIG. 14 is a cross sectional elevational view of a typical horizontal sill, the section being taken on the line 14—14 of FIG. 1.

DESCRIPTION OF THE PREFERRED EMBODIMENTS

FIG. 1 shows a building, designated generally as 20, which is constructed in part of masonry 21, with an opening in the front in which a wall system, designated generally as 22, constructed in accordance with the invention is installed. The wall system includes sills 23, vertical jamb members 24, headers 25, vertical mullions 26 (including an expansion vertical mullion 27), and intermediate horizontal mullions 28. Mounted in these frame members are panels 29, and door 30. Panels 29 may be made of glass or other suitable materials and may be transparent, translucent, or opaque. Panels of different kinds may be included in the same wall system.

Figure 2:
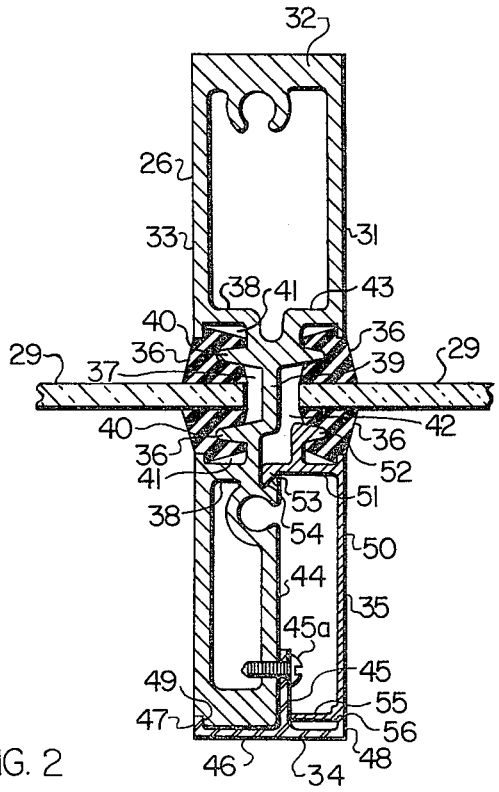
FIG. 2 is a cross sectional plan view of a typical vertical mullion of the invention, the section being taken on the line 2—2 of FIG. 1 and the scale being much enlarged in comparison with FIG. 1.

Attention is next directed to FIG. 2, which shows in plan cross section a typical vertical mullion 26 constructed in accordance with the invention. As can be seen from that FIG. the vertical mullion 26 is generally rectangular in plan cross section with a long side 31 and a short side 32. The term "narrow" is used herein to designate the shortness of side 32. In the commercial form of the invention side 32 is one inch; it may be made even smaller, the lower limit being about three-fourths inch. The length of long side 31 is partly determined by strength considerations and partly by aesthetic considerations. In the commercial form of the invention side 31 is 4½ inches, but it may be greater or less.

The vertical mullion 26 includes three metal parts: the mullion proper (or mullion base piece) 33; a mullion stop 34; and a mullion filler 35. It also includes four resilient glazing gaskets 36, formed of a suitable material such as extruded vinyl resin. Gaskets 36 are fitted to the mullion and directly grip panels 29.

As can be seen from FIG. 2, (and also FIGS. 3–5) the mullion proper 33 has a generally rectangular shape with one quadrant omitted. The omitted quadrant is the lower right hand quadrant as FIGS. 2–5 are drawn. On the left long side of mullion base piece 33, a glazing pocket 37 is formed. It is midway of the side in the embodiment shown in the drawings, but it may be displaced toward one end or the other if desired. Glazing pocket 37 has sides 38, and a floor 39. Protrusions 40 are formed in the glazing pocket 37 to create grooves 41 in which the glazing gaskets 36 are fitted.

On the other long side 31 of mullion proper 33, opposite glazing pocket 37, one half of a glazing pocket is formed. The half-pocket is designated 42 in the drawings. It includes a side wall 43 and shares floor 39 with glazing pocket 37. By utilizing common floor 39 for both glazing pockets, their depth is maximized in relation to the length of narrow side 32 of mullion proper 33. This in turn provides the maximum maneuvering room for panel edges during panel installation, and for maximum glass bite after fitting of the glazing gaskets.

As a consequence of omitting the lower right hand quadrant from the profile of mullion proper 33, it has a recessed side wall 44 which is substantially aligned with floor 39 of the glazing pockets.

The mullion stop 34 is T-shaped in cross section, with the leg 45 of the "T" being proportioned to fit against and be attached (as by screw **45*a*) to recessed wall 44 of the mullion proper. The arm 46 of the T is proportioned to extend across the narrow side of the overall mullion 26 and form the narrow face thereof. Arm 46 is provided with reentrant edge portions 47 and 48. Edge portion 47 fits in a small corner recess 49 in mullion proper 33, and edge portion 48 engages the mullion filler 35**, as is discussed below. In this manner the joint lines between the mullion stop and the mullion proper and mullion filler respectively are placed in unobtrusive locations. If a joint line running midway of the narrow face of the mullion is considered unobjectionable, the mullion stop may have an L-shaped profile instead of a T-shaped profile.

Mullion filler 35 is generally U-shaped in cross section, the base 50 of the "U" being a portion of the overall mullion long side wall. One leg 51 of the U is a side wall of glazing pocket 42. It is formed with a glazing gasket protrusion 52, and an interlock protrusion 53, which locks in a groove 54 formed in the mullion proper. The other leg 55 of the U is proportioned to engage the mullion stop 34 near the base of leg 45, and has a small recess 56 which engages reentrant protrusion 48 of mullion stop 34.

Figure 3:
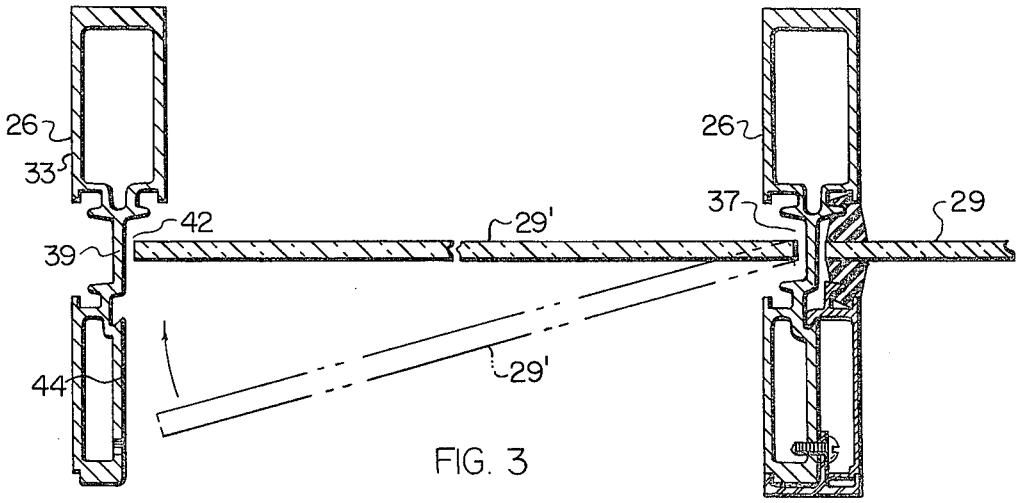
FIGS. 3, 4, and 5 are sequential cross sectional plan views of adjacent vertical mullions, showing sequential stages in the installation of a panel therebetween, the scale being somewhat reduced in comparison with FIG.
Figure 4:
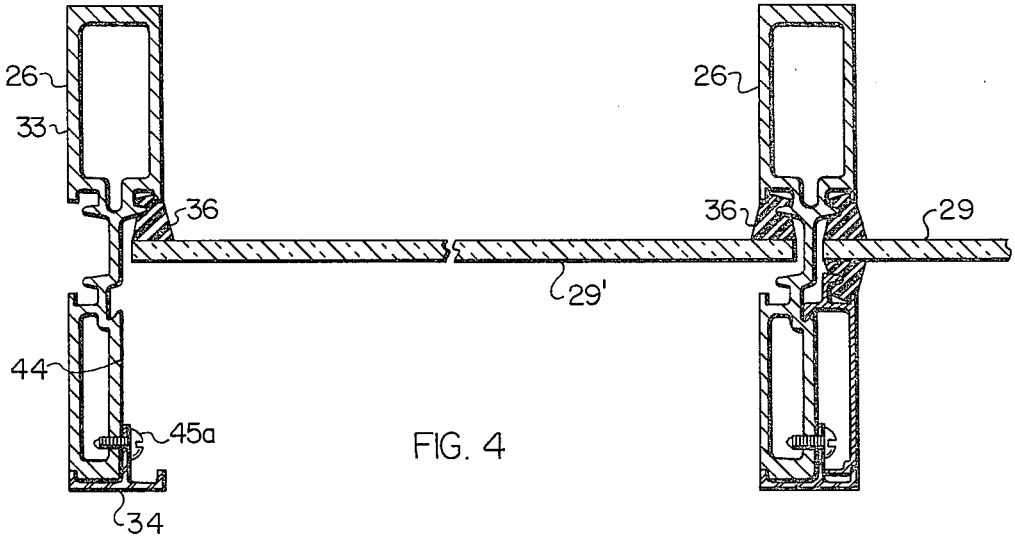
Figure 5:
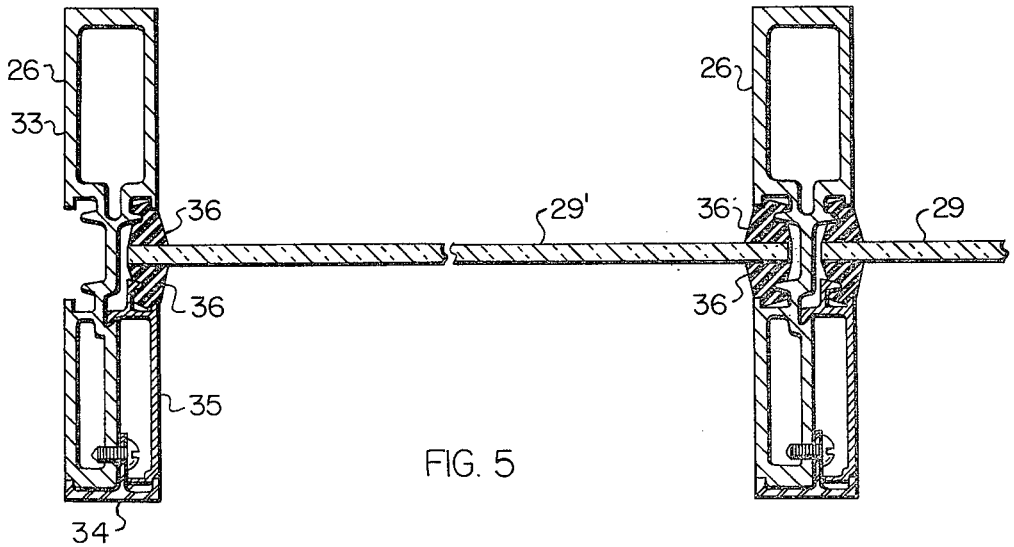

With the foregoing description of the structure of a vertical mullion in hand, attention is now directed to FIGS. 3–5, which show successive stages in the installation of a panel between two such vertical mullions. For the sake of simplicity in illustration and discussion, FIGS. 3–5 do not show an intermediate horizontal mullion or a horizontal sill member, one or the other of which would normally run between the two vertical mullions shown in these FIGS.

As can be seen from FIGS. 3 and 4, the space into which the panel 29' is to be installed is bounded on the right by a vertical mullion 26 having its full glazing pocket 37 facing the space, and on the left by a vertical mullion 26 having its half-pocket 42 facing the space.

At the outset of the glazing operation, (FIG. 3), the gaskets are not installed on the mullions, nor are the mullion stop and mullion filler installed on the left mullion. The panel 29' is brought up to the space and pivoted so that its right hand edge is in full glazing pocket 37 of the right mullion. This position of the panel is shown in ghost outline in FIG. 3. Panel 29′ is then pivoted clockwise about its right edge, which is maintained in pocket 37, until it reaches the position shown in full lines in FIG. 3, with its left edge in half-pocket 42. Since the right edge of panel 29′ is deep in full pocket 37 throughout this movement, enough clearance is created at the left edge of panel 29′ for it to clear recessed wall 44 and floor 39 of the half-pocket 42. In the next stage of installation, (FIG. 4), the panel is centered, if necessary, the interior glazing gaskets 36 are installed, and mullion stop 34 is attached, by screws 45*a*, to the mullion proper 33.

The last steps of panel installation are shown in FIG. 5, where it can be seen that the mullion filler 35 is locked into engagement with mullion proper 33 and mullion stop 34, and exterior glazing gaskets 36 are installed.

From the foregoing, it can be seen that it was the temporary absence of the lower right quadrant of mullion proper 33 (later supplied by stop 34 and filler 35) which made it possible to seat panel 29′ in half-pocket 42, notwithstanding that full pocket 37 is only about one-half inch deep, and the panel is sized to have a glass bite of almost one-half inch.

FIG. 6 illustrates in cross section a vertical jamb member 24, which includes a base plate 57, and a main mullion piece 58. Both pieces are secured to masonry 21 by screws 59. The main mullion piece 58 is provided with a deep glazing pocket 60 which extends for substantially the full thickness of the jamb. This deep glazing pocket provides enough maneuvering room for positioning a panel even though the glazing pocket of the opposite vertical mullion is shallow, i.e. about one-half inch. Glazing gaskets 61 are the same in profile and means of mounting as gaskets 36.

FIG. 7 shows in cross section a vertical expansion mullion 27. It has substantially the same parts as standard vertical mullion 26, and these components are therefore given the same reference characters as were used in FIG. 2. However, mullion proper 33 is formed in two parts, designated 33*a* and 33*b*, which are movable laterally with respect to each other, gaskets 62 being mounted to accommodate the sliding of parts 33*a* and 33*b* relative to each other. In addition, mullion stop 34′ is L-shaped instead of T-shaped, since a joint line is inherent on the narrow face of an expansion mullion. In long horizontal runs of wall framing system, considerable lateral stresses can build up, attributable to the coefficient of thermal expansion of the metal. Installation of expansion mullions 27 at intervals in such long runs accommodates for, and relieves, such stresses.

FIGS. 8A and 8B are cross sectional plan views showing modifications of vertical mullions 26 to act as door jambs. The basic structure of the mullions shown in FIGS. 8A and 8B is that shown in FIG. 2 and described above in connection therewith.

FIG. 8A illustrates mullion 26 employed as a jamb for center-hung door 63. Full glazing pocket 37 is filled by pocket filler 64, which is held in place by screws 65. FIG. 8B shows a mullion 26 employed as a jamb for edge-hung door 63′. Pocket filler 64′ has an integral door stop 66, equipped with a gasket 67.

In FIG. 9 there is shown in vertical cross section a typical horizontal mullion 28 constructed in accordance with the invention. Mullion 28 is generally rectangular in profile with glazing pockets 68, 69 formed in its long sides. In order to provide maximum depth to the pockets to maximize glass bite, they have a common pocket floor 70. The glazing gaskets 71 are the same as those used on the vertical mullions previously described, and they are mounted in the same way.

Internally, horizontal mullion 28 is provided with four integral splines or keys 72 running longitudinally in the interior space on either side of the glazing pocket region of the mullion. Splines 72 are part of the joint forming system of the invention, which is discussed below in connection with FIGS. 10–12.

The joint pin of the invention is shown in isometric view, partly broken out, in FIG. 10, where it is designated 73. It is a pin of relatively large diameter with respect to the space available in the interior of horizontal mullion 28.

Joint pin 73 is provided with four keyways 74 running longitudinally thereof. When a joint pin is inserted into the interior of a horizontal mullion 28, keyways 74 slidingly engage splines 72 inside the mullion.

Pin 73 is provided with an axial bore 75 for receiving a screw driven through a mullion or jamb exterior wall against which the end of the pin has been placed in abutment. This mode of joint formation is used on some occasions in accordance with the invention, for example, to attach a horizontal mullion to a vertical jamb 24.

In other modes of use of the joint pin of the invention, the joint pin is abutted against the interior or exterior of recessed wall 44 of mullion proper 26, or against the interior of a side wall of the mullion proper, and again, the attachment is made by a screw driven into bore 75. For example, when a horizontal mullion abuts a door jamb midway of the height of the door (a situation not appearing on FIG. 1), one joint pin 73 is passed through a hole drilled in a side wall of the vertical mullion which is acting as the door jamb, and is abutted against the interior of the opposite side wall. The other joint pin is passed through a side wall of the vertical mullion and abutted against the interior of the recessed wall 44 of the mullion proper. At an expansion vertical mullion 27, one of the joint pins 73 is abutted against the exterior of recessed wall 44.

At a crossing of horizontal and vertical mullions, such as that occurring at 76 on FIG. 1, the joint pin 73 is passed though all walls of the vertical mullion, and positioned so that it extends into the horizontal mullions on each side of the vertical mullion.

From the foregoing it is apparent that the joint pin 73, in its various uses in the wall system, occupies a variety of lateral positions with respect to the side face of the vertical mullion or jamb with which it cooperates. In order to provide for securing the joint pin to the horizontal mullion 28, a series of predrilled holes are provided in the floors of keyway 74 of pin 73. These holes are so located along the length of pin 73 that for every standard position of the pin (some of which were discussed above), there is a hole aligned a predetermined distance from the side face of the vertical mullion. Thus an installer need only measure out this predetermined distance from the mullion to find the location to drill a hole in the face of the horizontal mullion and install a screw which penetrates into the aligned hole in pin 73.

This aspect of the invention is illustrated very diagrammatically in FIG. 12, where three pins 73 are shown in different standard positions with respect to mullion 26. In all three positions a hole 77 is aligned at a given predetermined distance, indicated by the dotted line 78, from the side face of mullion 26.

FIG. 11 illustrates the joint at the crossing 76 (FIG. 1) of a vertical mullion 26 and two horizontal mullions 28. A pair of joint pins 73, one of which is out of sight in the FIG. are passed through the walls of mullion 26, and into the interiors of horizontal mullions 28. Keyways 74 of the pin engage splines 72. One hole 77 is aligned at the standard predetermined distance, and a screw 79 is applied.

FIGS. 13 and 14 show in elevational cross section a header 25, and a sill 23, respectively. A consideration of these FIGS. will reveal that the same extrusion profiles are involved in each, thus reducing the number of parts involved in the system. Header 25 and sill 23 include a base piece 80, attached to masonry 21 by screws 81, and panel fillers 82, which snap interlock to base pieces 80. Glazing gaskets 83 are of the same kind as is employed in the remainder of the system, and are mounted in the same manner.

What is claimed is:

1. A vertical mullion especially adapted for use in a narrow wall framing system comprising:

a mullion base piece which is generally rectangular in cross section with one quadrant of the rectangle omitted, and having a first glazing pocket formed in a long side thereof and one side and the floor of a second opposed glazing pocket formed on the long side whereat the quadrant is omitted;

a mullion stop attached to said mullion base piece at the short side thereof whereat the quadrant is omitted, said mullion stop being proportioned to establish a length for said short side substantially equal to the length of the other short side of the mullion base piece;

and a mullion filler attached to said mullion base piece at the long side thereof whereat the quadrant is omitted, and attached to said mullion stop, said mullion filler having the other wall of said second glazing pocket formed therein.

2. A vertical mullion in accordance with claim 1 in which said mullion filler is interlocked to said mullion base piece and to said mullion stop.

3. A vertical mullion in accordance with claim 1 in which said mullion base piece and said mullion filler are provided with glazing gasket gripping means.

4. A vertical mullion in accordance with claim 1 in which said mullion base piece has a recessed wall extending along one side of the omitted quadrant in substantial alignment with the floor of said second glazing pocket.

5. A vertical mullion in accordance with claim 4 in which said mullion stop has a leg abutting said recessed wall.

6. A vertical mullion in accordance with claim 4 in which said mullion stop is generally T-shaped in cross section, with the leg of the T abutting said recessed wall, and the head of the T is proportioned to establish a length for the short side of the mullion whereat the quadrant is omitted substantially equal to the length of the other short side of the mullion base piece.

7. A vertical mullion in accordance with claim 6 in which the edges of the head of the T of the mullion stop have reentrant protrusions thereon in engagement with said mullion base piece and said mullion filler.

* * * * *